US007950544B2

(12) United States Patent
Blossom

(10) Patent No.: US 7,950,544 B2
(45) Date of Patent: May 31, 2011

(54) SUPPORT AND STAND FOR FURNITURE FROM KEGS

(76) Inventor: Chase M. Blossom, Boise, ID (US)

( * ) Notice: Subject to any disclaimer, the term of this patent is extended or adjusted under 35 U.S.C. 154(b) by 822 days.

(21) Appl. No.: 11/700,364

(22) Filed: Jan. 30, 2007

(65) Prior Publication Data

US 2008/0179935 A1 Jul. 31, 2008

(51) Int. Cl.
*B65D 25/00* (2006.01)
*A47C 7/62* (2006.01)

(52) U.S. Cl. ..... 220/634; 297/188.01

(58) Field of Classification Search ..... 220/634, 220/729, 735, 601, 4.04, 4.05, 600, 4.01, 220/4.08, 4.17, 4.16, 4.12, 4.13, 4.33, 4.28, 220/DIG. 1; 297/423.1, 461, 188.01, 188.08, 297/440.22, 217.7, 188.2, 188.12; 108/139, 108/141, 50.11; *A47C 7/62, 7/00*
See application file for complete search history.

(56) References Cited

U.S. PATENT DOCUMENTS 249,135 A * 11/1881 Wilson ..... 297/235
2,024,330 A * 12/1935 Bemis ..... 248/158
2,357,046 A * 8/1944 Hewitt ..... 297/461
3,905,522 A * 9/1975 Johnston ..... 222/400.7
4,428,305 A 1/1984 Creske ..... 108/150
4,690,299 A * 9/1987 Cannon ..... 220/592.19
D412,348 S 7/1999 Gebauer et al. ..... D21/397
2006/0087162 A1 4/2006 Sylvester ..... 297/188.01

* cited by examiner

*Primary Examiner* — Anthony Stashick
*Assistant Examiner* — Robert J Hicks
(74) *Attorney, Agent, or Firm* — Pedersen and Company, PLLC; Ken J. Pedersen; Barbara S. Pedersen

(57) ABSTRACT

The present invention is a top stand platform for furniture manufactured from beer kegs. The top stand platform has a first load distribution ring which circumvents the outlet opening at the center top of the keg at a level below the top flange of the outlet opening. Near its periphery, the first ring has a set of first threaded bolts extending downwardly onto the top surface of the keg. Also, the top stand platform comprises a second stand base ring, with a set of second threaded bolts which secure the second stand base ring to the top of the first load distribution ring. This way, the two first and second rings are clamped together and secured tightly to the flange of the outlet opening at the top of the keg. Secured to the top of the second stand base ring is an upwardly-extending base.

1 Claim, 10 Drawing Sheets

SUPPORT AND STAND FOR FURNITURE FROM KEGS

BACKGROUND OF THE INVENTION

1. Field of the Invention

This invention relates generally to furniture, especially chairs, stools and tables. Also, this invention relates to furniture accessories like, for example, coatracks, end tables and lamps. More specifically, this invention relates to furniture and accessories made with beer kegs.

2. Related Art

Other inventors have worked with beer kegs for furniture. For example, Sylvester, in U.S. Published Patent Application # US2006/0087162 A1, discloses a bar stool. manufactured from two empty kegs, the kegs being pivotally connected to each other end to end. The bottom of the bottom keg rests on the floor, and the top of the top keg supports a seat pad.

Also, Gebauer, et al., in U.S. Des 412,348 discloses a game table supported by a beer keg.

Still, there is needed a simple and secure support and stand for furniture and furniture accessories manufactured from beer kegs. The support for the bottom of the keg must be robust, and stabilize the keg from tipping. Preferably, the support also provides a footrest for the furniture. The stand for the top of the keg must also be robust, and stabilize what is placed on the stand, whether it be a lamp, flat platform, seat or table top, by efficiently distributing the load from the stand over the top surface of the keg. This invention addresses those needs.

SUMMARY OF THE INVENTION

The present invention is a bottom support and top stand platform for furniture and furniture accessories manufactured from beer kegs.

The bottom support comprises a set of radially spaced-apart feet which clamp to the bottom rim of a beer keg. Preferably, the spaced-apart feet are joined to a circular ring which circumvents the outside perimeter of the keg, the ring securing the feet in their spaced-apart radial relationship. Preferably, the ring is a foot rest which is supported a short distance outwardly from the keg, above the spaced-apart feet, by a set of outwardly and upwardly-angled support bars which extend from the spaced-apart feet at the bars' bottom, to the foot rest ring at the bars' upper end. The bottom support may exist also in other embodiments. For example, in an alternative embodiment, the spaced-apart feet may be joined to a rectangular frame, the sides of which extend between the feet underneath the bottom of the keg.

The top stand platform comprises a first load distribution ring which circumvents the outlet opening at the center top of the keg at a level below the top flange of the outlet opening. Preferably, the first load distribution ring is segmented, at least into two semicircular parts. Preferably, the top surface of the inner edge of the first ring is chamfered to fittingly receive the top flange of the keg outlet opening. This way, the level of the top surface of the first ring may be at about the same level as the top of the flange. Near its inner edge, the first ring has a set of first ring inner bored-through and threaded outer holes for receiving second threaded bolts. When fully assembled, as discussed below, the second threaded bolts secure the first ring to the second stand base ring. Near its periphery, the first ring has a set of first ring threaded bored-through and threaded outer holes for receiving first threaded bolts. When fully assembled, the first threaded bolts extend downwardly from the periphery of the first ring through the first ring holes onto the top surface of the keg. This way, the first threaded bolts redistribute the load received by the top of the first ring radially outwardly, and onto the top surface of the keg.

Also, the top stand platform comprises a second stand base ring, also with a set of second ring bored-through holes near its periphery. These second ring holes receive second threaded bolts, discussed briefly above, which secure the second stand base ring to the top of the first load distribution ring. This way, the two first and second rings are clamped together and secured tightly around the flange of the outlet opening at the top of the keg. Secured to the second stand base ring is an upwardly-extending base. Optionally, secured to the top of the base is a horizontal platform. The upwardly-extending base and/or the horizontal platform may support different components for different embodiments of the invention. For example, the horizontal platform may support a seat cushion, or a table top. Also, for example, the upwardly-extending base may support a coatrack or a lamp, plus a lamp shade.

DESCRIPTION OF THE PREFERRED EMBODIMENTS

Referring to the Figures, there are depicted several, but not all, embodiments of the present invention.

Figure 1:
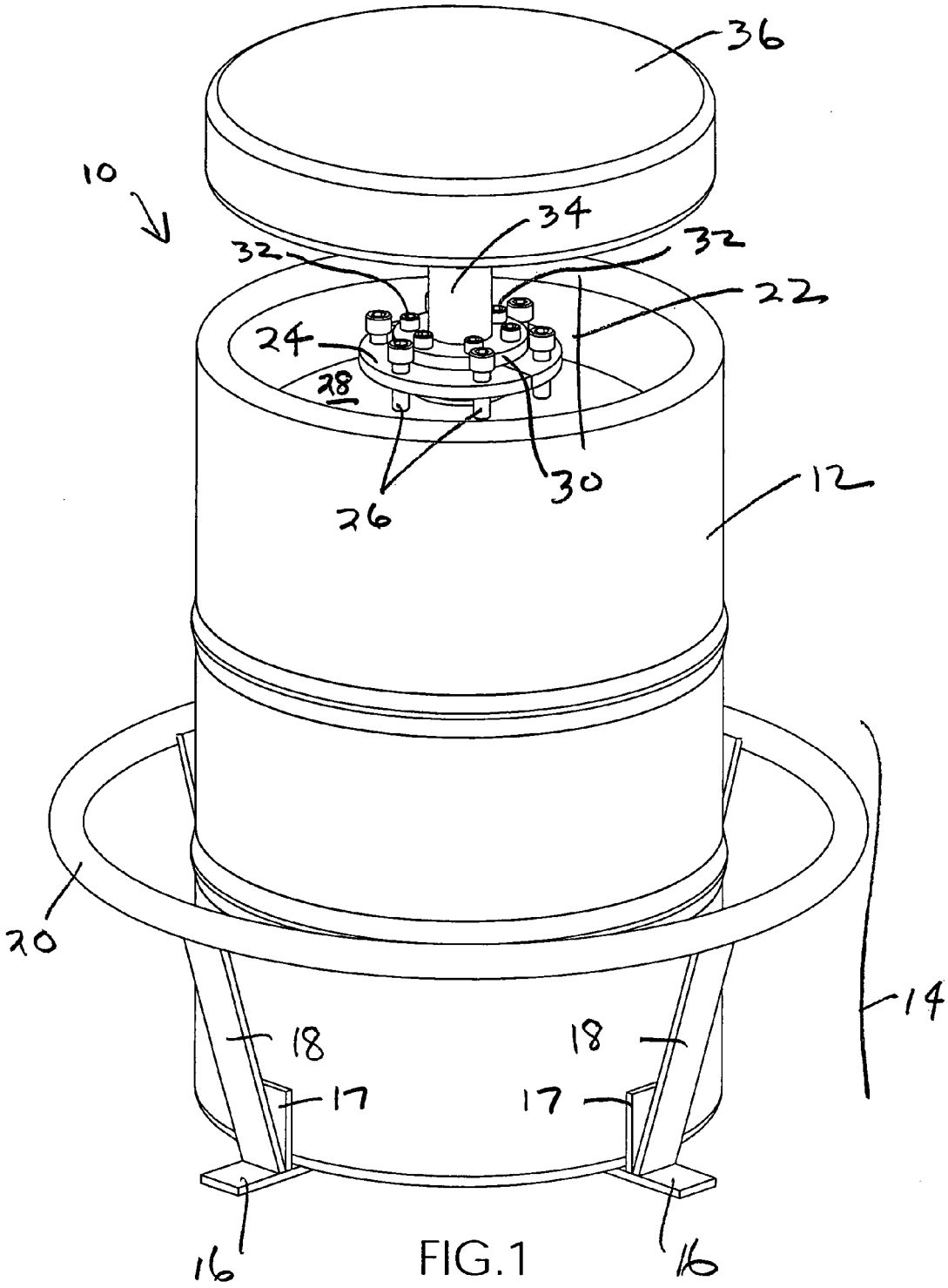
FIG. 1 is a side perspective view of one bar stool embodiment of the invention.

In FIG. 1 there is depicted bar stool 10, an embodiment of the invention. Bar stool 10 is manufactured from beer keg 12. Keg 12 may be new or used. Also, keg 12 may be any conventional commercial beer key from any commercial beer producer. Also, keg 12 may be a full-sized barrel, half-barrel or quartered-barrel keg.

At the bottom of keg 12 is support assembly 14, comprising radially spaced-apart feet 16, upwardly-extending outer clamp tabs 17, outwardly and upwardly-angled support bars 18, and circular foot rest 20. At the top of keg 12 is top stand platform 22, comprising first load distribution ring 24, and first threaded bolts 26 for supporting first ring 24 on the top surface 28 of keg 12. Also, top stand platform 22 comprises second stand base ring 30, and second threaded bolts 32 for securing the second ring to the first ring. Extending upwardly from second ring 30 is base 34 which supports bar stool cushion 36.

Figure 2:
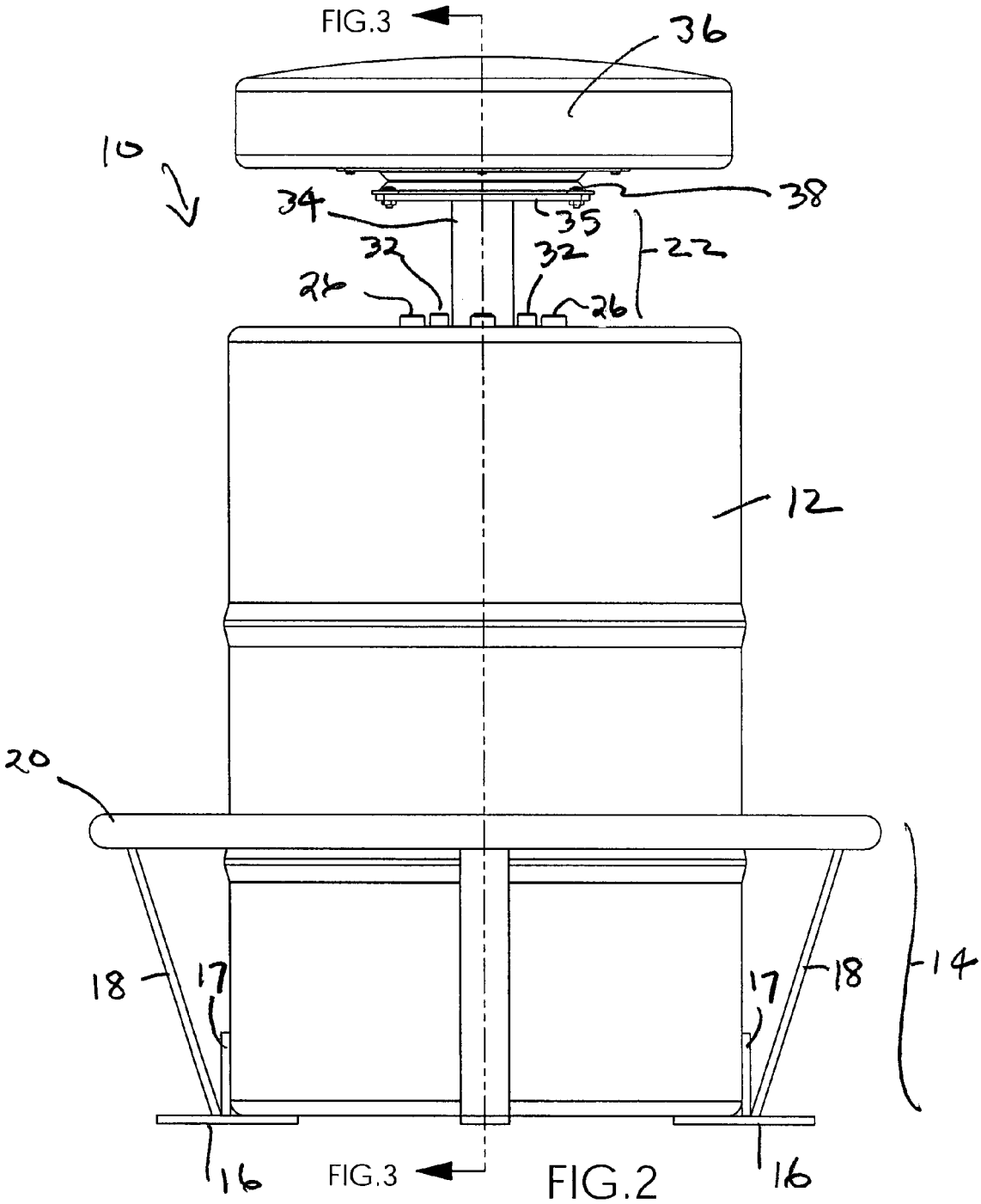
FIG. 2 is a side view of the embodiment depicted in FIG. 1.

In FIG. 2, there is depicted again bar stool 10, beer keg 12 and bottom support assembly 14. At the bottom of keg 12, support assembly 14 comprises spaced-apart feet 16, upwardly-extending outer clamp tabs 17, outwardly and upwardly-angled support bars 18, and circular foot rest 20. At the top of keg 12 is top stand platform 22, comprising first threaded bolts 26, second threaded bolts 32, and base 34 supporting horizontal platform 35 and bar stool cushion 36. Also depicted in FIG. 2 is a conventional "lazy-Susan" assembly 38 which allows cushion 36 to rotate, or spin, relative to the longitudinal axis of base 34.

Figure 3:
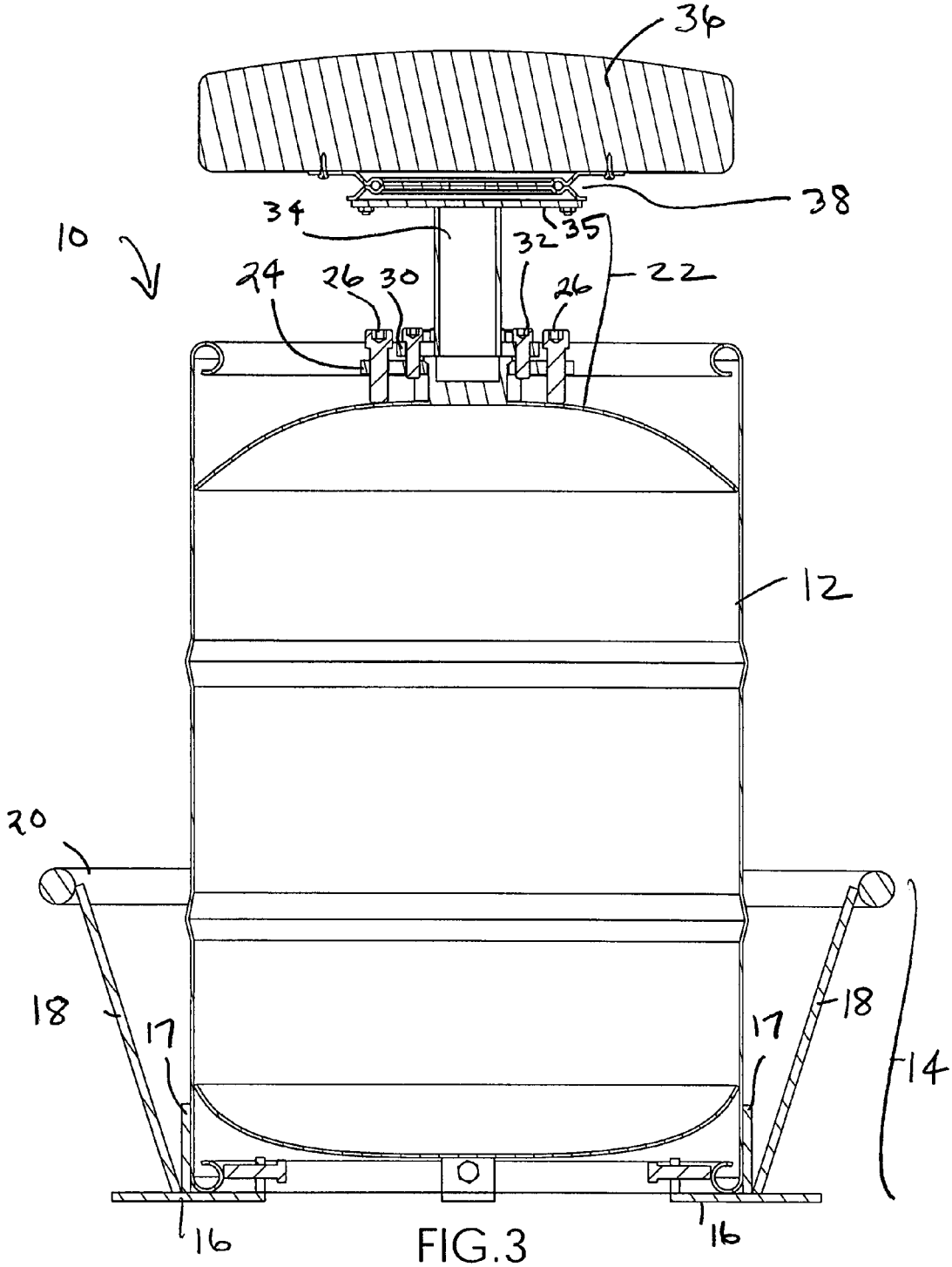
FIG. 3 is a side cross-sectional view taken along line 3-3 in FIG. 2.

In FIG. 3, there is depicted again bar stool 10, beer keg 12, and bottom support assembly 14, comprising spaced-apart feet 16, clamp tabs 17, support bars 18 and foot rest 20. Also, there is depicted again top stand platform 22, comprising first load distribution ring 24, first threaded bolts 26, second stand base ring 30, second threaded bolts 32, base 34, cushion 36 and "lazy-Susan" assembly 38.

Figure 4:
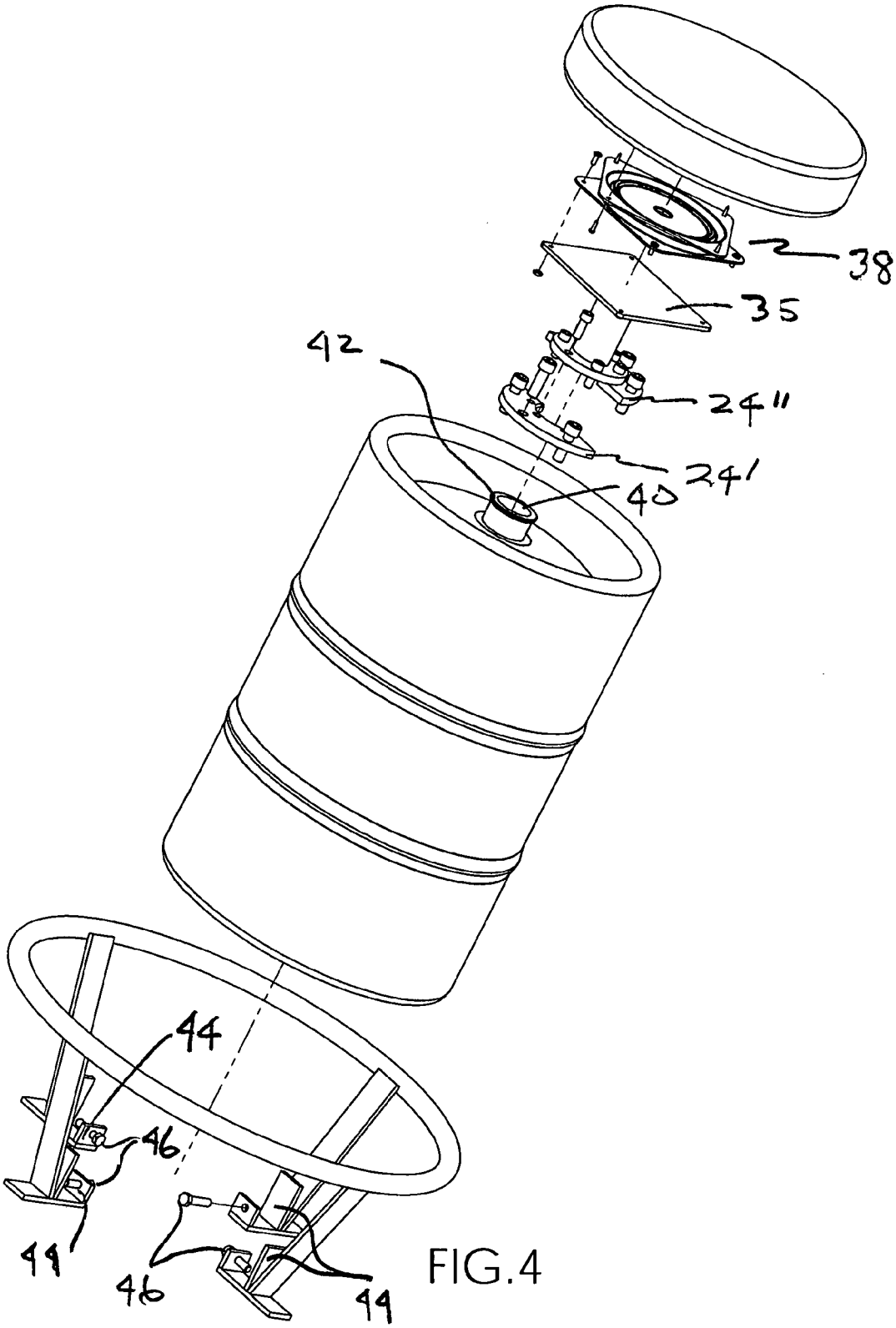
FIG. 4 is an exploded, side perspective view of the embodiment depicted in FIGS. 1-3.
Figure 5:
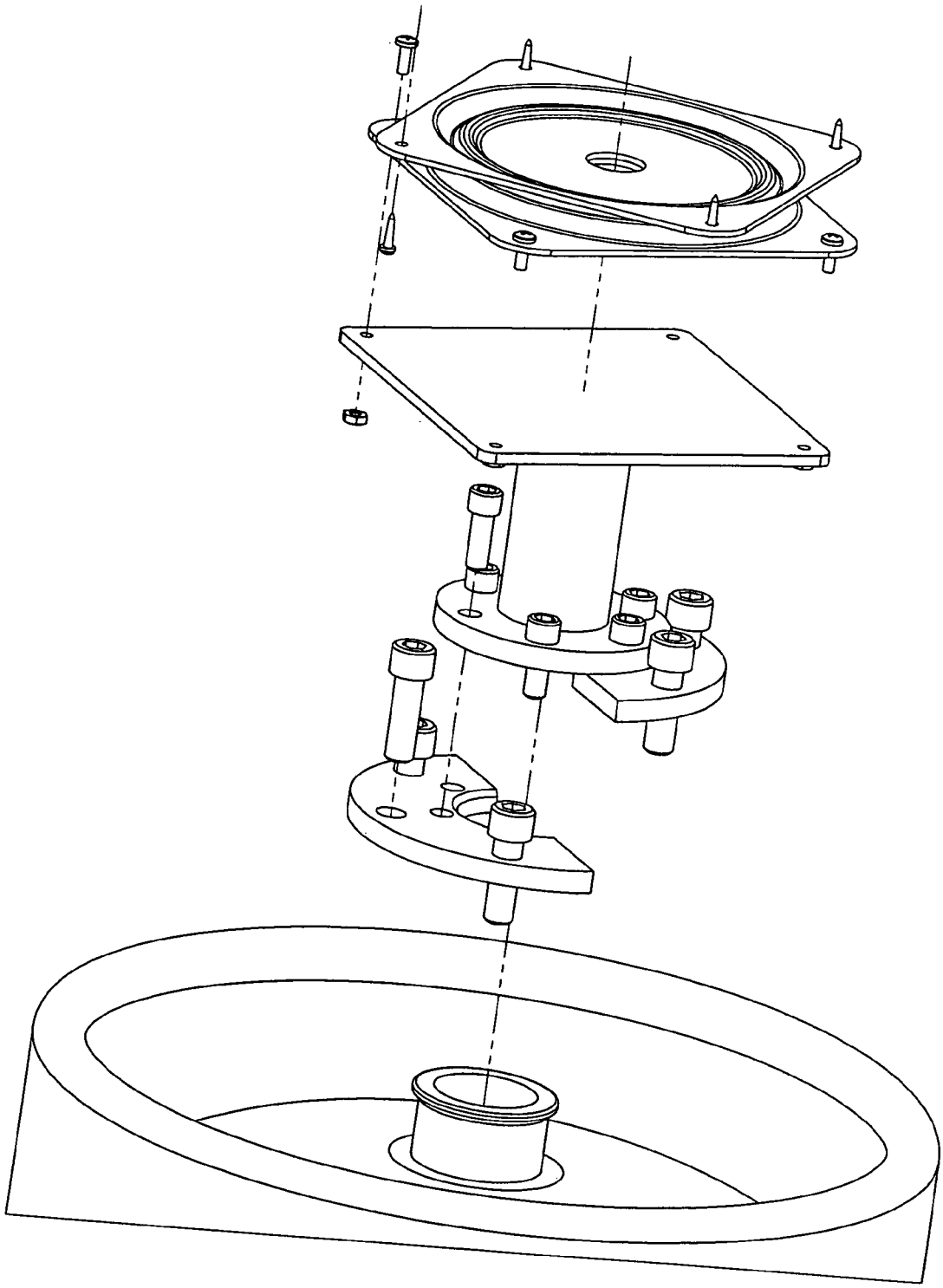
FIG. 5 is a detail, exploded, side perspective view of one embodiment of the top stand platform of the invention.
Figure 6:
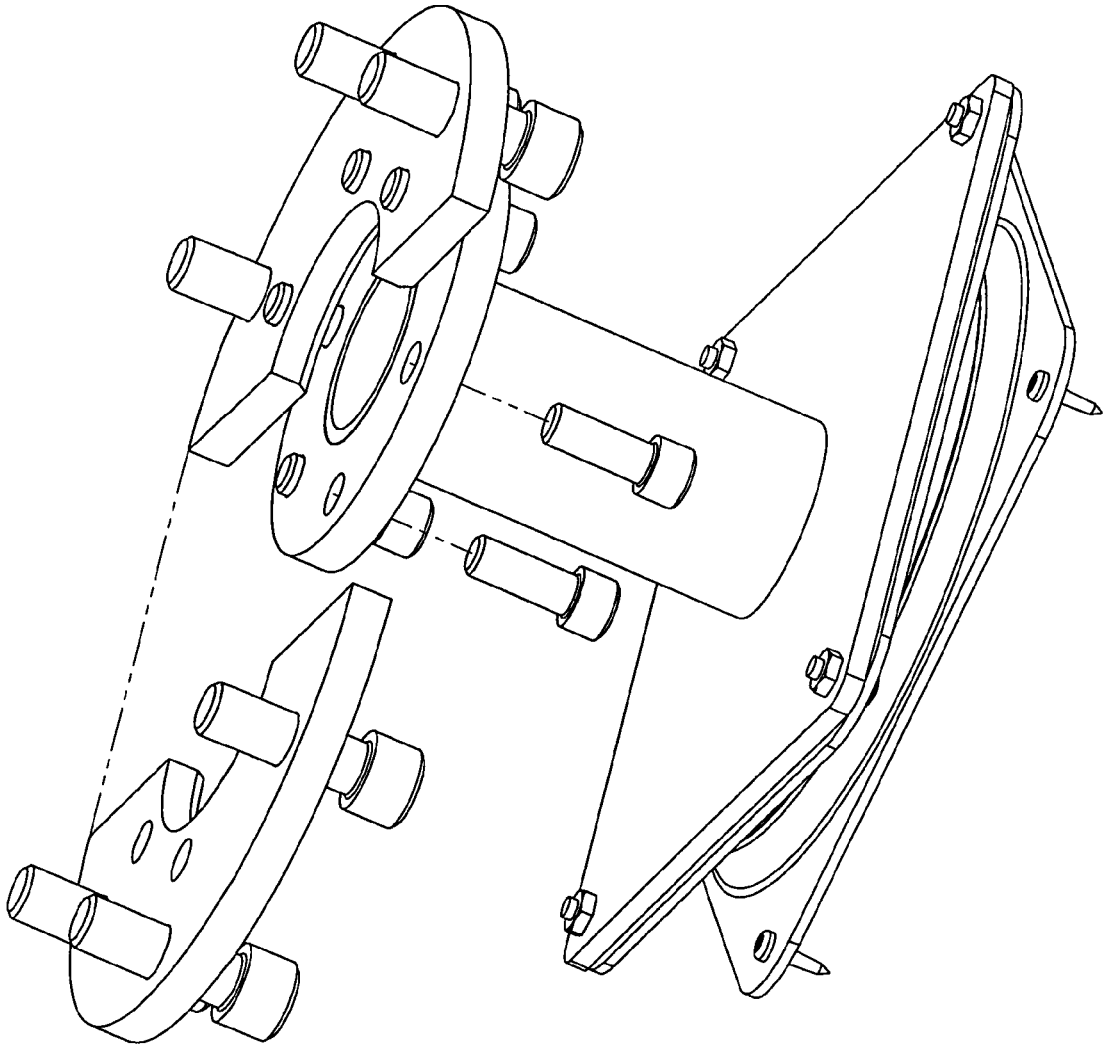
FIG. 6 is a detail exploded, bottom perspective view of one embodiment of the top stand platform of the invention.
Figure 7:
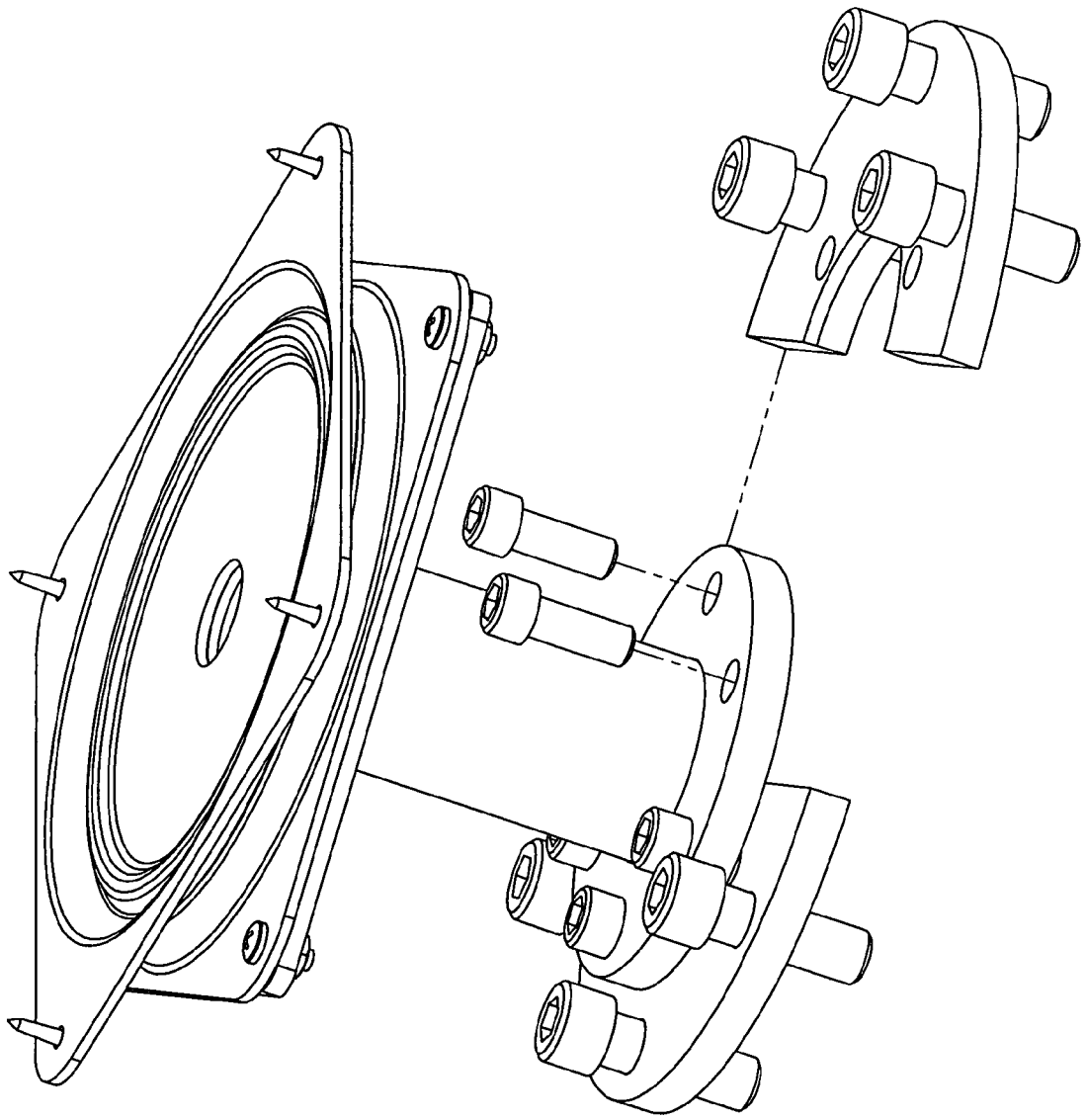
FIG. 7 is a top perspective view of the embodiment depicted in FIG. 6.
Figure 8:
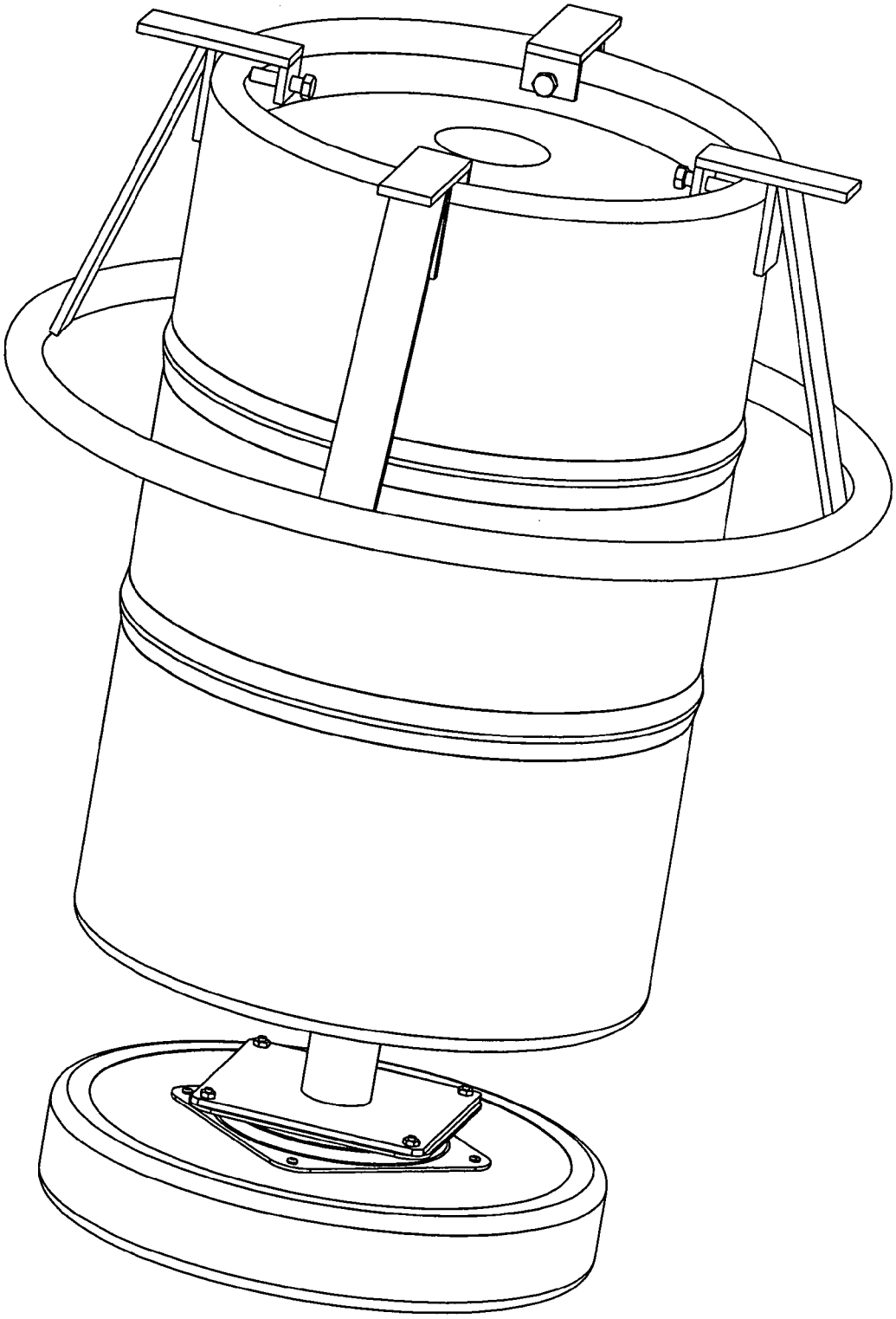
FIG. 8 is a bottom, perspective view of the embodiment depicted in FIG. 1.
Figure 9:
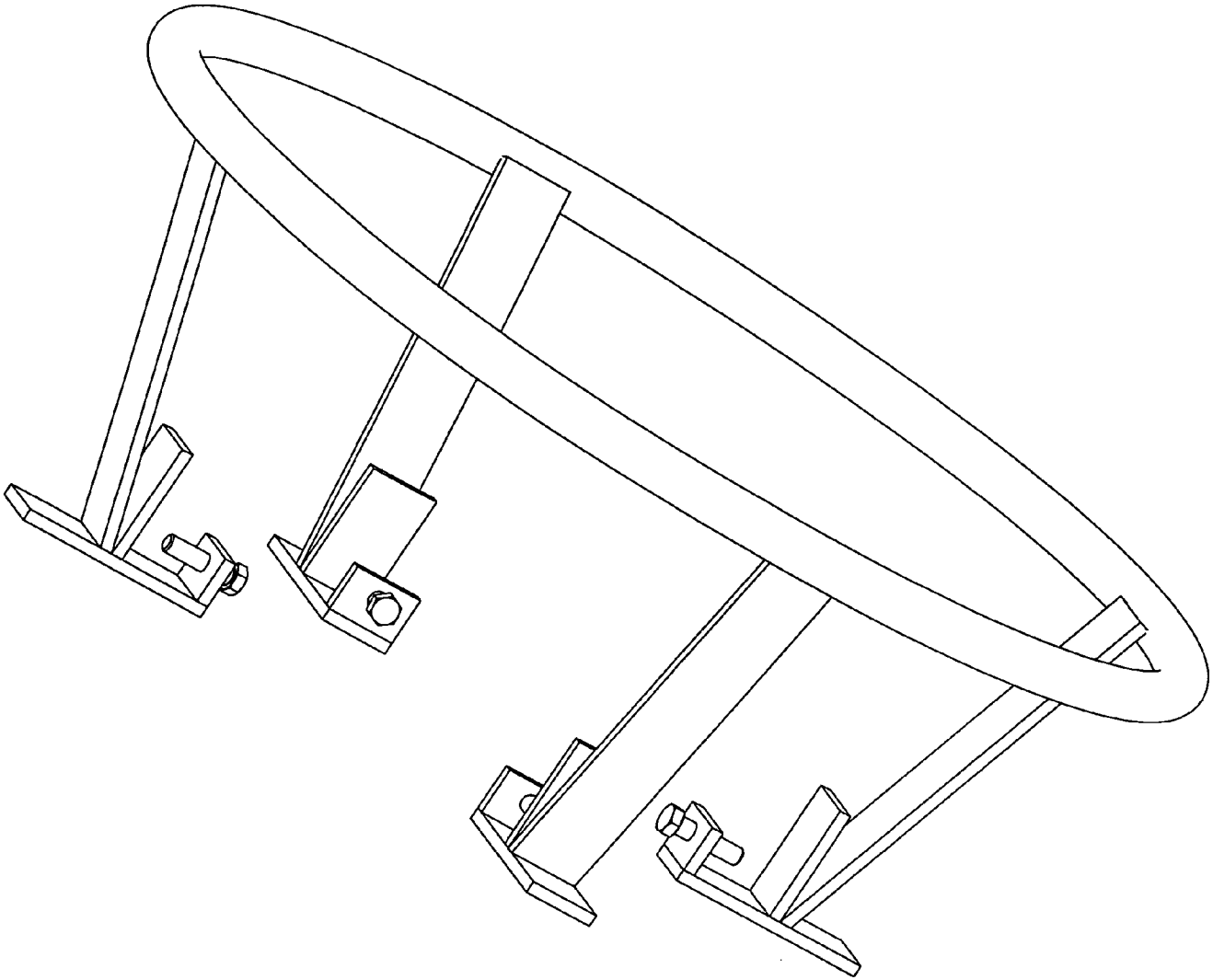
FIG. 9 is a side, perspective view of one embodiment of the bottom support of the present invention.

In FIG. 4, there is depicted for the first time an exploded view of conventional "lazy-Susan" assembly 38, and that first load distribution ring 24 as segmented into two semi-circles 24' and 24". Also newly depicted is keg top outlet opening 40 with outer flange 42. Also newly depicted are upwardly-extending inner clamp tabs 44 and clamping bolts 46 for the bottom support assembly 14.

In FIGS. 5-9, no elements of the invention are newly depicted. However, these Figures further illustrate how the various elements of the invention described above are related and interact and interfit.

Figure 10:
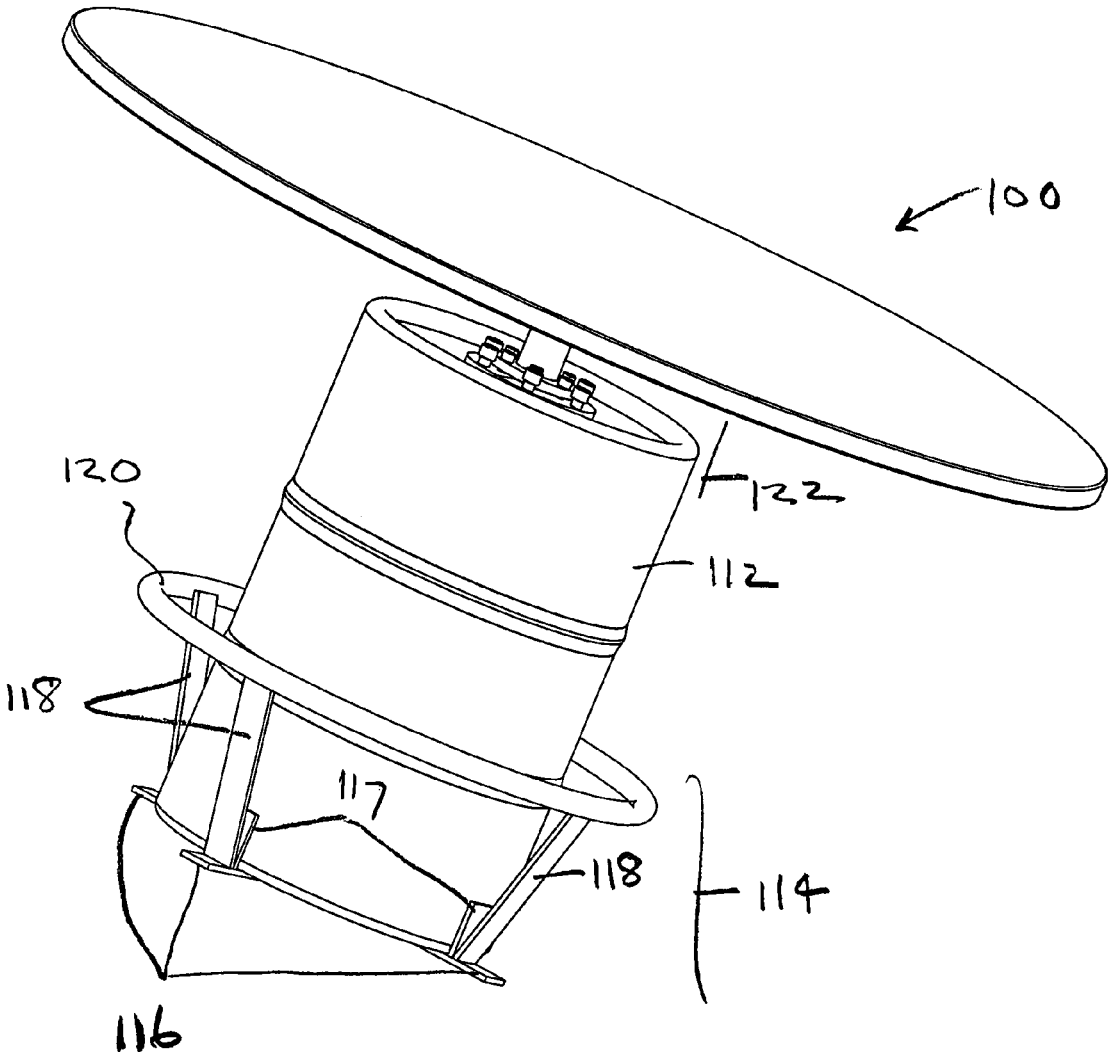
FIG. 10 is a side, perspective view of an alternate table embodiment of the present invention.

In FIG. 10, there is depicted an alternative embodiment of the invention. In FIG. 10, there is depicted bar table 100 which is manufactured from bar keg 112. At the bottom of keg 12 is support assembly 114, comprising radially spaced-apart feet 116, upwardly-extending outer clamp tabs 117, outwardly and upwardly-angled support bars 118, and circular foot rest 120. At the top of keg 12 is top stand platform 122, comprising first threaded bolts 126, second threaded bolts 132 and base 134 supporting bar table top 148. Table top 148 is secured to the top of a horizontal platform (not shown in this Figure) in the same manner as for top stand platform 22, discussed above.

Although this invention has been described above with reference to particular means, materials and embodiments, it is to be understood that the invention is not limited to these disclosed particulars, but extends instead to all equivalents within the scope of the following claims.

I claim:

1. A top stand platform for a beer keg utilized in furniture, comprising:

a first load distribution ring which circumvents an outlet opening, the outlet opening having a top flange and being near a center top of the keg, the first ring circumventing the outlet opening at a level below the top flange; said first load distribution ring having a set of first threaded bolts near its periphery extending downwardly onto and being supported by a top surface of the keg; a second stand base ring secured to a top of the first load distribution ring, so that said first and second rings are secured together tightly and secured together tightly around the flange of the keg outlet opening; and, an upwardly-extending base secured to said second stand base ring for supporting a furniture component.

* * * * *